US008308390B2

(12) United States Patent
Kao

(10) Patent No.: US 8,308,390 B2
(45) Date of Patent: Nov. 13, 2012

(54) SHOWER NOZZLE HAVING A BRUSH

(76) Inventor: Shen-Mu Kao, Bade (TW)

( * ) Notice: Subject to any disclaimer, the term of this patent is extended or adjusted under 35 U.S.C. 154(b) by 439 days.

(21) Appl. No.: 12/573,867

(22) Filed: Oct. 5, 2009

(65) Prior Publication Data

US 2010/0092231 A1 Apr. 15, 2010

(30) Foreign Application Priority Data

Oct. 9, 2008 (CN) ..... 2008 1 0148897

(51) Int. Cl.
*A46B 11/06* (2006.01)

(52) U.S. Cl. ..... 401/289; 401/291; 401/6

(58) Field of Classification Search ..... 401/6, 289, 401/283, 270, 282, 291
See application file for complete search history.

(56) References Cited

U.S. PATENT DOCUMENTS

| | | | | |
|---|---|---|---|---|
| 1,604,500 | A * | 10/1926 | Tannenbaum | 15/29 |
| 6,058,543 | A * | 5/2000 | Thompson | 15/29 |
| 6,170,108 | B1 * | 1/2001 | Knight | 15/29 |
| 7,503,715 | B2 * | 3/2009 | Khubani | 401/6 |
| 7,537,195 | B2 * | 5/2009 | McDaniel et al. | 251/129.04 |

* cited by examiner

*Primary Examiner* — David Walczak
(74) *Attorney, Agent, or Firm* — Chun-Ming Shih

(57) ABSTRACT

A shower nozzle having a brush for bathing includes a shower nozzle body and a brush head which is driven by a power member disposed in the shower nozzle body. The power member is supplied power by an internal battery or an external power supply. Thereby, when the user takes a bath, the combination of the shower nozzle and the brush is able to supply water for cleaning and has a brushing function, enhancing the cleaning effect.

4 Claims, 8 Drawing Sheets

SHOWER NOZZLE HAVING A BRUSH

BACKGROUND OF THE INVENTION

1. Field of the Invention

The present invention relates to a cleaning device for a human body, and more particularly to a shower nozzle providing brushing and washing functions.

2. Description of the Prior Art

In general, a shower nozzle is used to supply water for taking a bath. First, the user sprinkles water on his/her body and applies soap or shower cream to the body. Finally, he/she washes the body. Some people use a brush to scrub his/her body when taking a bath. It is inconvenient to take a brush and a shower nozzle as well as soap or beauty products at one time.

Accordingly, the inventor of the present invention has devoted himself based on his many years of practical experiences to solve this problem.

SUMMARY OF THE INVENTION

The primary object of the present invention is to provide a shower nozzle having a brush for bathing, which includes a shower nozzle body and a brush head which is driven by a power member disposed in the shower nozzle body. The power member is supplied power by a battery. Thereby, when the user takes a bath, the combination of the shower nozzle and the brush is able to supply water for cleaning and has a brushing function. The present invention cleans skin pores and skin and removes cutin efficiently.

In order to achieve the aforesaid object, the present invention comprises a main body, a power member, and a brush head. The bottom of the main body is formed with a connecting part for connecting with a water tube for water supply. The main body is provided with a battery and the power member therein. The battery supplies power to start the power member. The power member has an output shaft. The front of the output shaft is coupled to the brush head which is driven by the power member. The brush head has at least one aperture for spraying water. The battery is rechargeable. The brush head can be replaced for hygiene.

DETAILED DESCRIPTION OF THE PREFERRED EMBODIMENTS

Embodiments of the present invention will now be described, by way of example only, with reference to the accompanying drawings.

Figure 1:
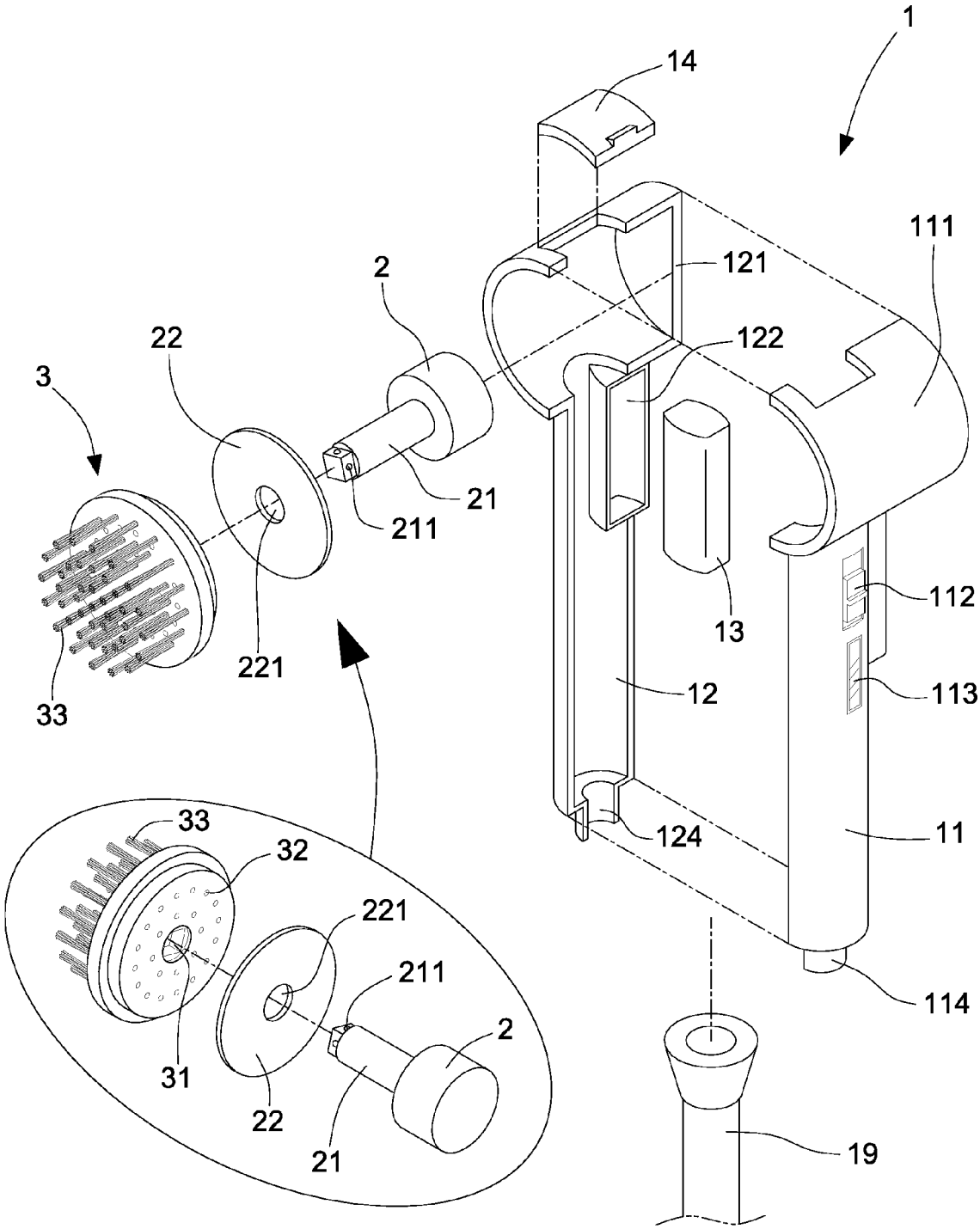
FIG. 1 is an exploded view of the present invention.
Figure 2:
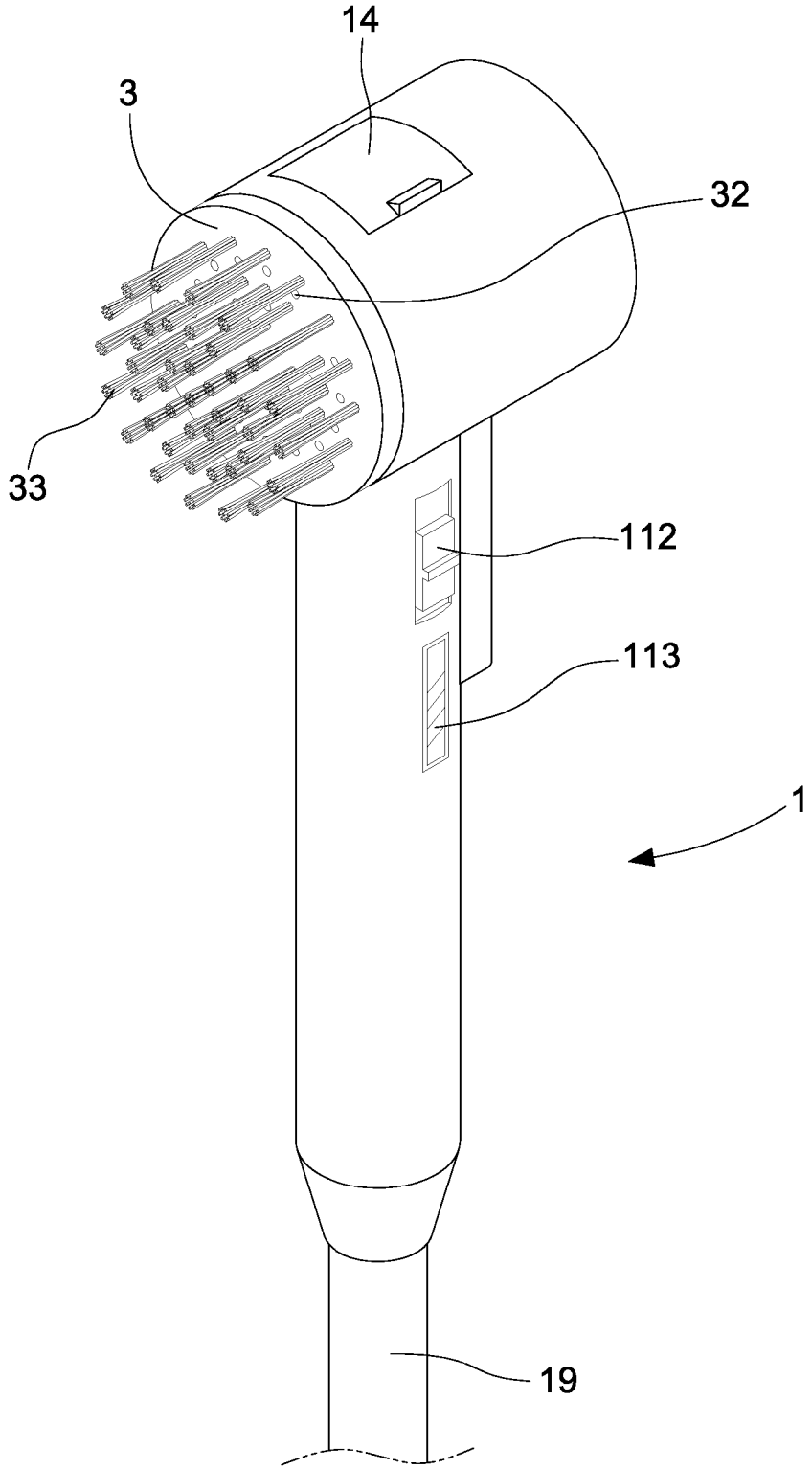
FIG. 2 is a perspective view of the present invention.

As shown in FIGS. 1 and 2, a shower nozzle having a brush according to a preferred embodiment of the present invention comprises a main body 1, a power member 2, and a brush head 3.

The main body 1 is composed of a first housing 11 and a second housing 12. The first housing 11 includes an upper lid 111, a switch 112, a display 113, and a connecting part 114. The second housing 12 includes an upper lid 121, a battery trough 122, and a connecting part 124. The connecting parts 114,124 are adapted to connect with a water tube 19 for water supply. The main body 1 is provided with a movable cover 14 thereon. The battery trough 122 is adapted to receive a battery 13 therein. The display 113 is used to show the power condition.

The power member 2 can be a motor, which is disposed between the upper lids 111, 121 and connected with the battery 13 to get power for rotation. The power member 2 is provided with a waterproof plate 22 and other parts for waterproofing. The power member 2 includes an output shaft 21 extending through a through hole 221 of the waterproof plate 22.

The brush head 3 has a shaft hole 31 for engaging with the output shaft 21, at least one aperture 32 thereon, and bristles 33 on a front surface thereof.

Figure 3:
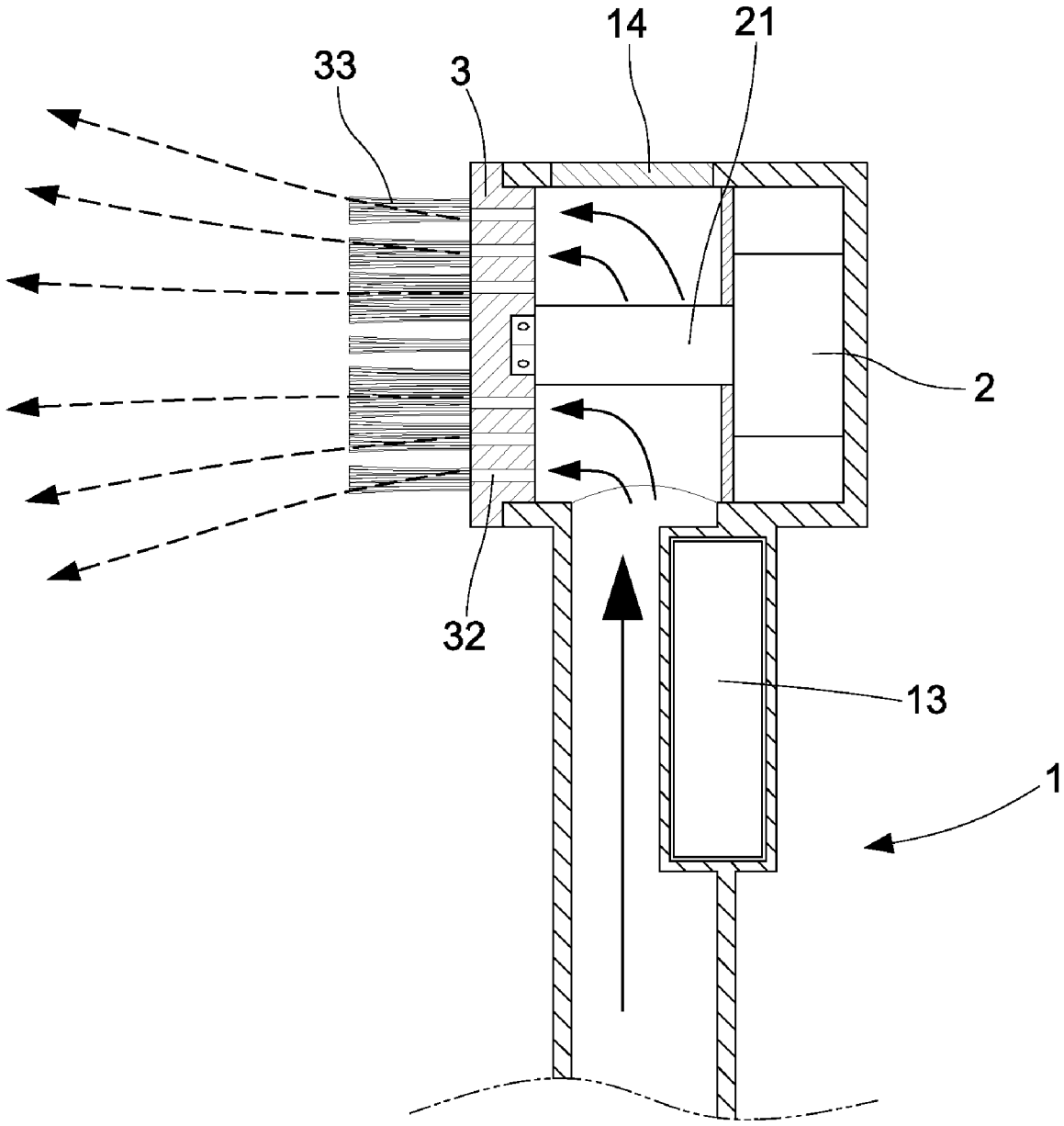
FIG. 3 is a cross-sectional view of the present invention when in use.
Figure 4:
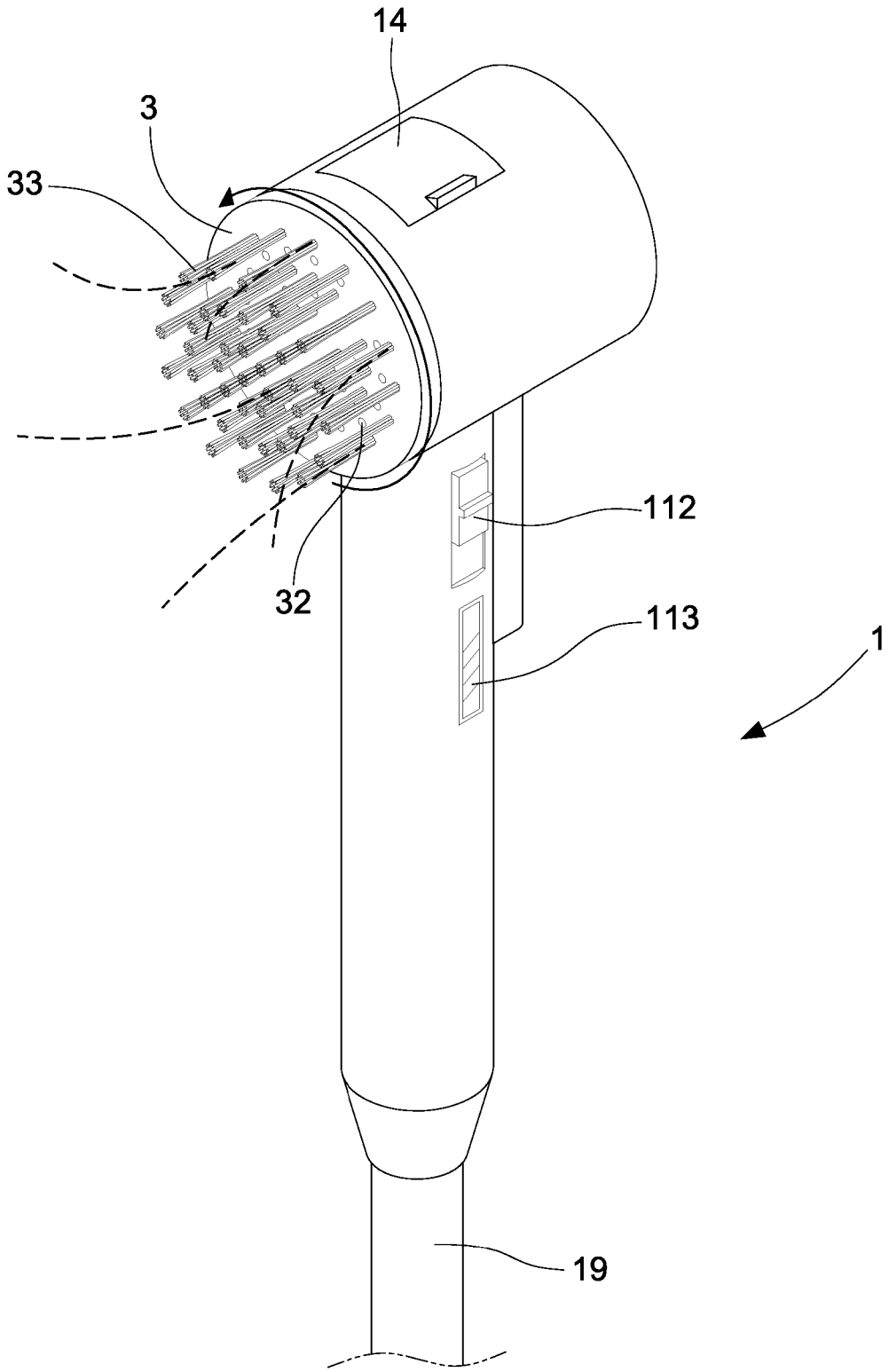
FIG. 4 is a perspective view of the present invention when in use.

As shown in FIGS. 2 and 3, water enters the main body 1 through the water tube 19 into the chamber between the first and second housings 11, 12 and the upper lids 111, 121, and flows out from the aperture 32 of the brush head 3 for the user to take a shower. When the switch 112 is turned on to start the power member 2, the shat 21 will be turned to drive the brush head 3, as shown in FIG. 4. The bristles 33 contact the skin of the user for cleaning skin pores and skin and removing cutin. The water flows out from the aperture 32 while the brush head 3 is rotated so as to facilitate bathing.

Figure 5:
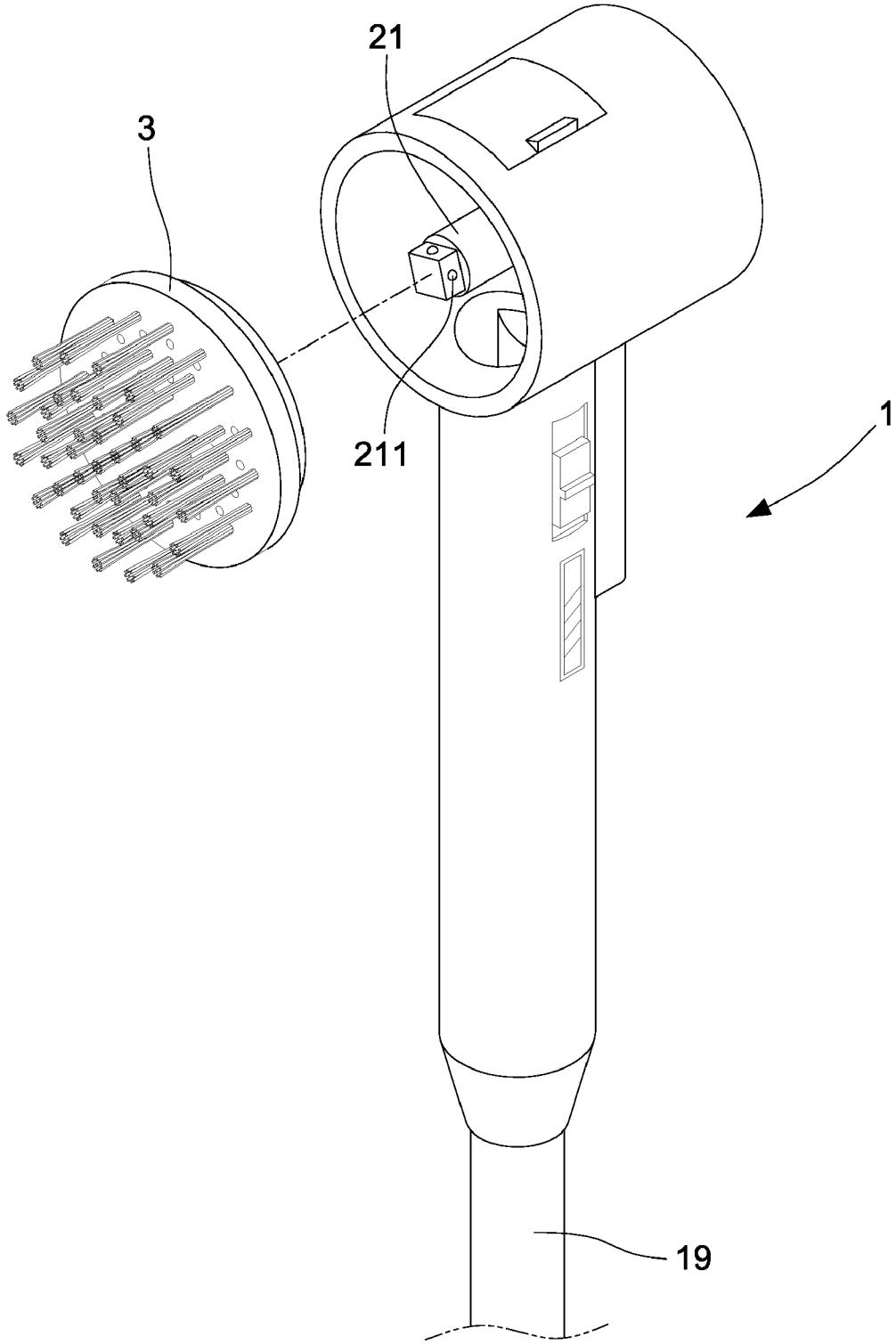
FIG. 5 is a schematic view showing a brush head of the present invention to be separated.

As shown in FIG. 5, the brush head 3 is adapted to engage with an engaging member 211 provided on the output shaft 21 so that the brush head 3 can be replaced for hygiene.

Figure 6:
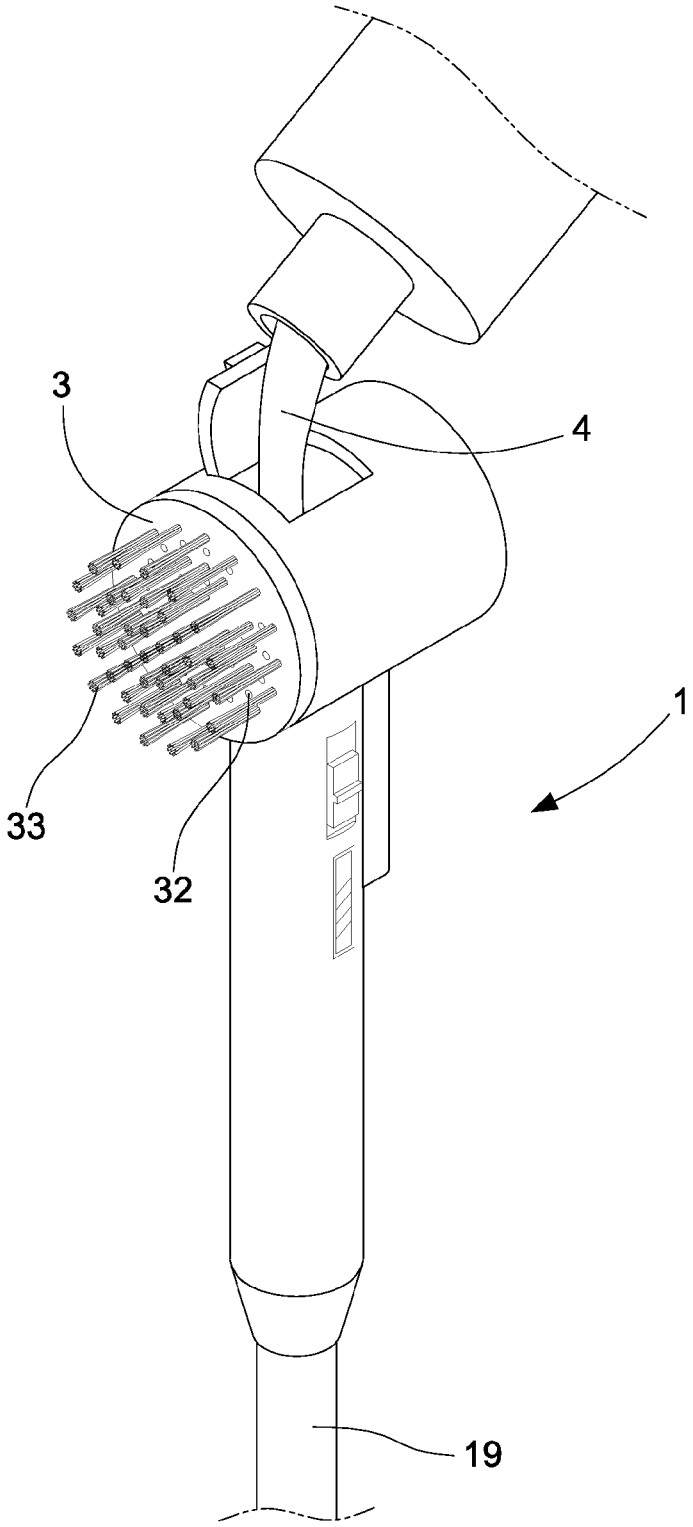
FIG. 6 is a schematic view showing the present invention to be filled in shower cream.

As shown in FIG. 6, the main body 1 of the present invention is provided with the movable cover 14 for filling in shower cream 4 or beauty products to mix with the water in the main body 1 and flow out from the aperture 32.

Figure 7:
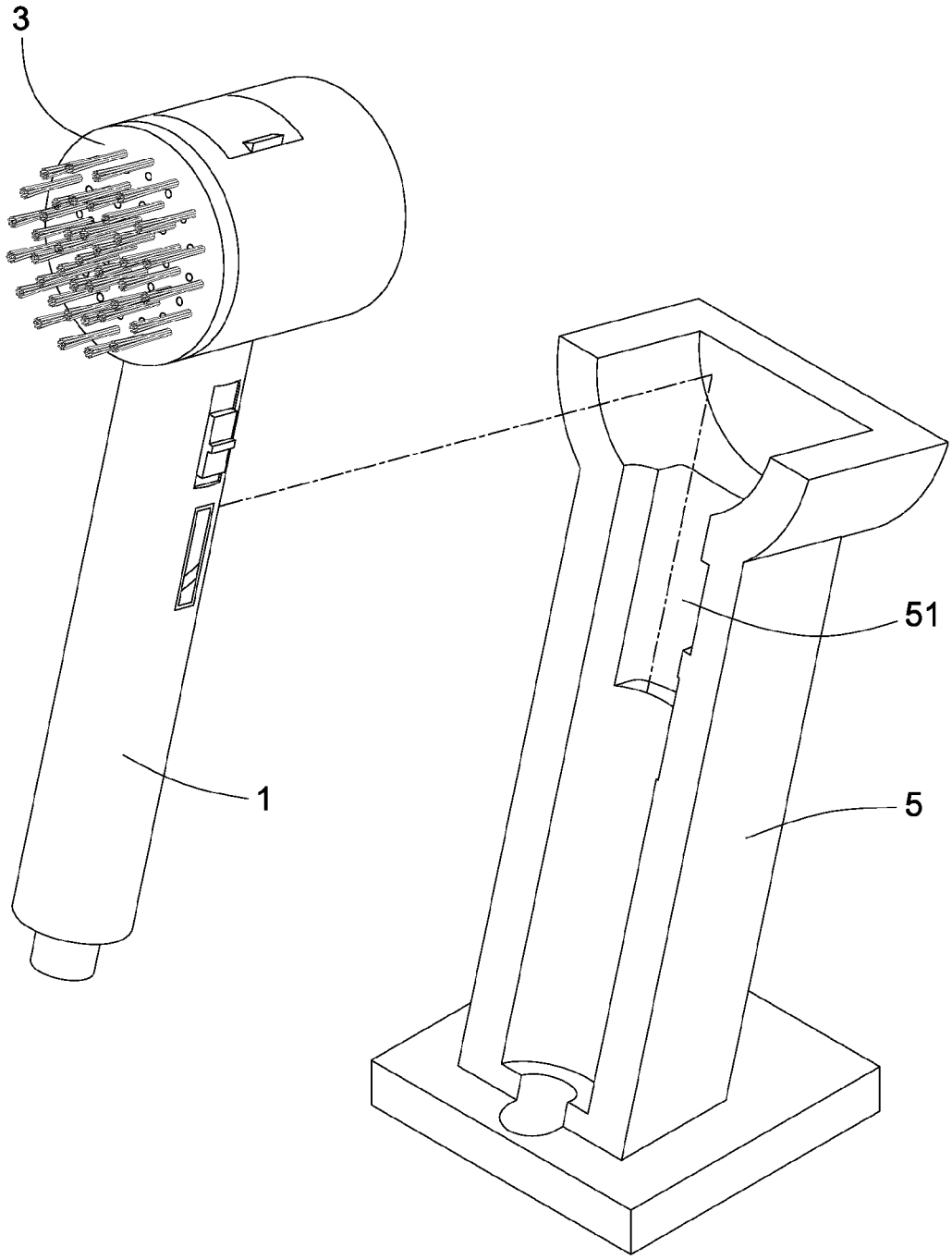
FIG. 7 is a schematic view showing the present invention to be charged.
Figure 8:
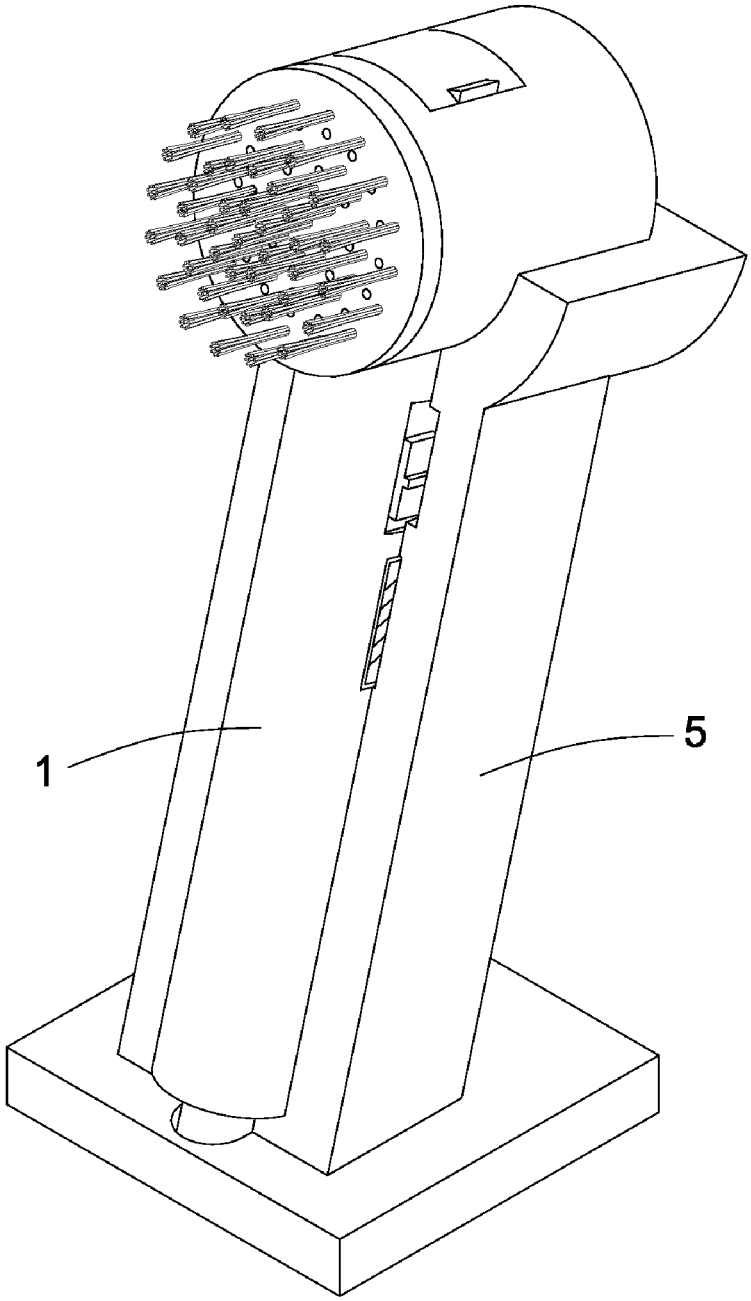
FIG. 8 is a perspective view showing the present invention to be charged.

The battery 13 is rechargeable, which is incorporated with a charging seat 5, as shown in FIG. 7. Referring to FIGS. 1, 7, 8, the main body 1 and the water tube 19 are separable. The main body 1 is placed on the charging seat 5. The charging seat 5 is formed with an inductive charging area 51 for the battery 13 to charge. The charging technique may adopt point charging or inductive charging, which is not the feature of the present invention and won't be described hereinafter.

The present invention can be provided with a sensing member at a desired place. When the main body 1 approaches a human body, the sensing member is able to detect automatically for starting the power member 2 to drive the brush head in a predetermined period of time, providing an automatic starting and timing effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower nozzle having a brush, comprising:

a main body composed of a first housing and a second housing substantially symmetrically in shape, the first housing including a first upper part, a first lower part connected to the first upper part and having a switch and a display formed on an outer surface thereof, and a first connecting part connected to the first lower part, the second housing including a second upper part, a second lower part having a battery trough formed therein and a second connecting part, wherein the first and the second connecting parts are adapted to connect with a water tube to supply water, the battery trough is adapted to receive a battery therein, and the display is used to show the power condition of the battery;

a power member disposed in a room formed by the first and the second upper parts of the main body, the power member including a motor connected with the battery to get power for operation, a waterproof plate having a through hole formed thereon, which divides the room into a first section and a second section for accommodating the motor, and an output shaft extending from the motor and through the through hole into the first section; and a brush head coupled to the first section of the main body and connected with the output shaft of the power member, the brush head having at least one aperture and bristles on a front surface thereof.

2. The shower nozzle having a brush as claimed in claim 1, wherein the output shaft is provided with an engaging member for engaging with the brush head.

3. The shower nozzle having a brush as claimed in claim 1, wherein the main body is provided with a movable cover on top of the first and the second upper parts for filling in shower cream.

4. The shower nozzle having a brush as claimed in claim 1, wherein the battery adapted to be in the main body is incorporated to a charging seat for charging.

* * * * *